US007191774B2

(12) United States Patent
Thorne

(10) Patent No.: US 7,191,774 B2
(45) Date of Patent: Mar. 20, 2007

(54) ACCURATE TOY AIR GUN TARGETS

(76) Inventor: Robert E. Thorne, 700 Warren Rd., Apt. 24-2D, Ithaca, NY (US) 14850

( * ) Notice: Subject to any disclaimer, the term of this patent is extended or adjusted under 35 U.S.C. 154(b) by 115 days.

(21) Appl. No.: 10/871,826

(22) Filed: Jun. 18, 2004

(65) Prior Publication Data

US 2004/0255922 A1 Dec. 23, 2004

Related U.S. Application Data

(60) Provisional application No. 60/480,487, filed on Jun. 21, 2003.

(51) Int. Cl.
*F41B 11/00* (2006.01)

(52) U.S. Cl. ..... 124/55

(58) Field of Classification Search ..... 124/55
See application file for complete search history.

(56) References Cited

U.S. PATENT DOCUMENTS

| | | | | |
|---|---|---|---|---|
| 1,473,178 | A | 11/1923 | Dray | |
| 1,611,533 | A | 12/1926 | Kirsten | |
| 1,926,585 | A | 9/1933 | Gibbons | 124/8 |
| 2,534,398 | A | 12/1950 | Beathan | 124/1 |
| 2,540,060 | A * | 1/1951 | Szantay | 446/489 |
| 2,543,651 | A | 2/1951 | Weiss | 124/1 |
| 2,614,551 | A | 10/1952 | Shelton | 124/1 |
| 2,628,450 | A | 2/1953 | Shelton | 46/9 |
| 2,846,996 | A | 8/1958 | Drynan | 124/1 |
| 2,855,714 | A | 10/1958 | Thomas | 42/57 |
| 2,879,759 | A | 3/1959 | Webb | 124/1 |
| 3,117,567 | A | 1/1964 | Allen | 124/1 |
| 3,342,171 | A | 9/1967 | Ryan et al. | 124/1 |
| 3,465,741 | A | 9/1969 | Daniel et al. | 124/1 |
| 3,884,471 | A | 5/1975 | Maurer et al. | 273/101.2 |
| 4,157,703 | A | 6/1979 | Brown et al. | 124/55 |
| D259,335 | S | 5/1981 | Gillespie | D9/337 |
| 6,421,502 | B1 | 7/2002 | Aronie et al. | 392/399 |
| 6,694,658 | B1 * | 2/2004 | Marsac | 42/54 |
| 6,983,742 | B2 * | 1/2006 | Jordan et al. | 124/56 |
| 2003/0034020 | A1 * | 2/2003 | Irizarry et al. | 124/56 |

* cited by examiner

*Primary Examiner*—Troy Chambers
(74) *Attorney, Agent, or Firm*—Brown & Michaels, PC

(57) ABSTRACT

A toy air gun and in particular an improved air gun for generating vortex rings are described. The gun is designed so that the path along the axis of air motion from the rear of the gun to the air exit hole is optically transparent, and contains patterns normal to this axis that assist in accurate sighting. This allows targets to be directly sighted along the axis of air or vortex ring travel. Together with improvements to ensure purely axial air motion, this dramatically increases the aiming accuracy of this class of gun and makes it suitable for target-type activities. A screen with a cylindrically symmetric pattern of openings and aiming marks prevents solid objects placed inside the gun's barrel from being projected outwards, and assists in aiming the gun. An vented safety guard at the exit end of the gun prevents large pressures from developing in the event that the gun exit is blocked while preserving the vortex ring component to the airflow.

30 Claims, 8 Drawing Sheets

Fig. 8A
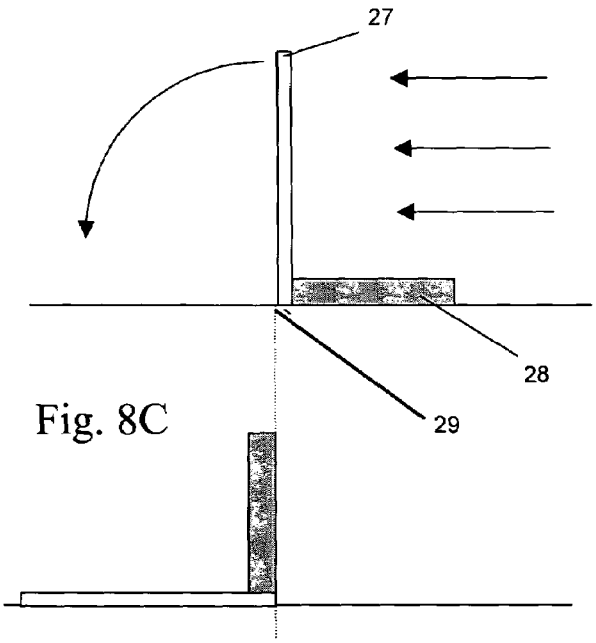
Fig. 8B
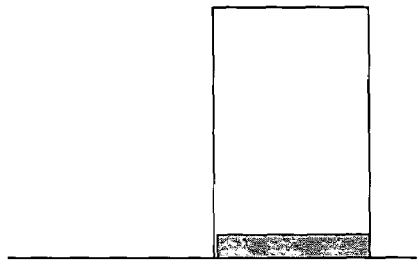
Fig. 8C
Fig. 9A
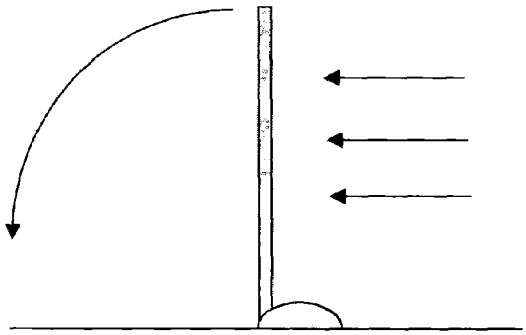
Fig. 9B
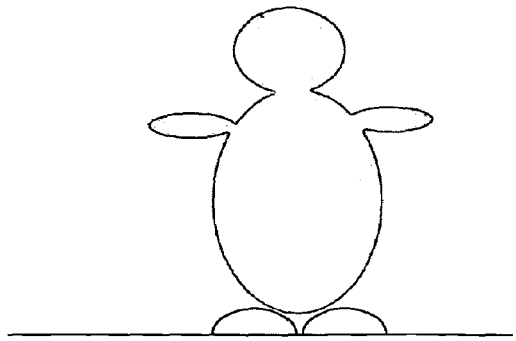

ACCURATE TOY AIR GUN TARGETS

REFERENCE TO RELATED APPLICATIONS

This application claims an invention which was disclosed in Provisional Application No. 60/480,487, filed Jun. 21, 2003, entitled "Improved Toy Guns With Targets." The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of toy guns that generate bursts of air to function. More particularly, the invention pertains to improvements in aiming accuracy and to safety of the toy guns and targets for use with these guns.

2. Description of Related Art

Conventional toy guns that shoot solid projectiles (for example, plastic balls) can be dangerous, and both these guns and guns that shoot water are unsuitable for indoor use in ordinary living areas where they may damage furniture and other household items.

Toy guns that shoot air provide fewer personal injury risks and can be suitable for indoor use. For example, U.S. Pat. No. 4,157,703 to Brown et al. (1979) shows a toy gun, in which an elastic diaphragm is deflected by an impulsive force produced by a trigger mechanism, producing a burst of air that can be used to knock down small targets at short range.

A different class of toy air gun generates vortex rings of air. Unlike air blasts from the Brown et al. device, vortex rings are interesting objects in and of themselves. They are highly stable and can travel great distances from their sources while maintaining their shape and intensity before dissipating. Vortex rings are localized disturbances in the air that propagate through the air with a well-defined speed. When the vortex rings strike an object they exert a brief impulsive force due to their forward motion and the rapidly circulating air within them. Consequently, they behave very much like solid projectiles, but without their associated risks.

Toy guns for producing vortices in air have been patented. U.S. Pat. No. 1,473,178 to W. R. Dray (1923) describes a gun in which a flexible diaphragm is retracted by hand and then released, blowing air out a cylindrical tube. This design is very similar to that of the "AirZooka" currently marketed by Zero Toys of Concord, Mass. U.S. Pat. No. 2,534,398 to Beathan (1950) describes a vortex gun with a spring-loaded diaphragm and a circular aperture. U.S. Pat. No. 2,543,651 to Weiss (1951) uses a piston to strike a flexible membrane and force air out a circular aperture. U.S. Pat. No. 2,614,551 to Shelton (1952) describes several configurations of a toy vortex gun, generally consisting of a flexible or rigid diaphragm and mechanisms for displacing it to shoot a burst of air through a circular aperture. U.S. Pat. No. 2,879,759 to Webb (1959) describes a variant on Shelton's basic designs. These guns have their own dangers, including the possibility of objects placed in the barrel being projected out, and of excessive pressure causing damage to, e.g., ears if the output opening is blocked. Other examples include U.S. Pat. No. 1,611,533 by Kirsten (1926); U.S. Pat. No. 1,926,585 by Gibbons (1933), U.S. Pat. No. 2,846,996 to Drynan (1958), U.S. Pat. No. 3,117,567 to Allen (1964), U.S. Pat. No. 3,342,171 to Ryan et al., (1967), U.S. Pat. No. 3,465,741 to Daniel et al. (1969), and U.S. Pat. No. 3,884,471 to Maurer et al. (1975).

U.S. Pat. No. 4,157,703 to Brown et al. (1979) describes safety features for toy air guns. A grid placed in front of the air-displacing member prevents objects placed inside the gun from being projected outward. A vented auxiliary parabolic cone on the outlet of the gun, whose outlet diameter is approximately equal to the diameter of the muzzle opening, provides pressure relief in the event that the outlet of the gun is blocked by, e.g., a child's ear. However both the positioning and patterning of the protective grid, the shape of the auxiliary cone, and the diameter of its opening are such as to dramatically reduce vorticity at the gun's output and the power of the vortex rings it produces, so that this design is a conventional air gun rather than a vortex ring gun. (This is in fact evident from the patent, which states the gun produces puffs of air and makes no mention of vortex rings.) This gun is also designed for relatively short-range targets (up to 8 feet), where airflow at the target will have a large non-vortex component so that the "projectile"-like behavior of any vortex ring is obscured.

Targets for toy air guns have been discussed in U.S. Pat. No. 1,473,178 to Dray (1923), U.S. Pat. No. 1,926,585 to Gibbons (1933), U.S. Pat. No. 2,534,398 to Beathan (1950), U.S. Pat. No. 2,614,551 to Shelton (1952), U.S. Pat. No. 3,884,471 to Maurer et al. (1975), and Des. 259,335 to Gillespie (1981). None of these targets are particularly interesting or entertaining, especially when compared with target-type activities possible with guns that shoot solid projectiles.

U.S. Pat. No. 2,628,450 to Shelton (1953) describes a variant on the vortex gun, which fills the chamber with smoke, so as to render the vortex visible (a smoke ring gun.) Subsequent patents for smoke ring guns include U.S. Pat. No. 2,855,714 to Thomas (1958), A very similar device described in U.S. Pat. No. 6,421,502 B1 to Aronie et al. (2002) is currently marketed as the "Zero Blaster" by Zero Toys. A disadvantage to smoke ring guns is that the air exit velocity and thus the vorticity and vortex velocity must be small; otherwise, the particulates cannot follow the vortex ring's motion and the "smoke ring" disappears. Consequently, they are unsuitable for target-type activities where an appreciable impulse must be delivered to the target to register a hit. Another disadvantage is that the materials used to make the rings visible are all irritants and many are toxic.

A major deficiency of all of these air guns is that they are extremely difficult to accurately aim. Unlike conventional toy guns, relatively large barrel diameters and air collimating or vortex producing apertures (typically 6–12 inches and 2 inches, respectively) are required to produce the strong air displacements and/or strong vortex rings capable of producing visible effects on targets at significant distances. Aiming sights placed on the outside of the barrel are far from the gun's axis, and the parallax between the sight line and the air burst/vortex ring trajectory and resulting aiming errors are large at all target distances, especially at larger distances where the air motion is due almost entirely to the moving vortex ring and where the striking, projectile-like behavior of the vortex ring is most apparent. Deviations in motion of the air-displacing membrane or piston from perfect cylindrical symmetry about the bore axis (as in, e.g., the AirZooka) also produces aiming errors and irreproducibility in air puff/vortex ring strength. No doubt it is for this reason that the commercially marketed vortex gun AirZooka doesn't include targets, and that earlier commercial air gun products included only very large, curtain-like targets that were easy to hit.

SUMMARY OF THE INVENTION

The invention consists of air gun or vortex ring gun modifications to realize a gun with much greater accuracy in target-type activities and with improved safety, as well as targets specifically designed for use with this class of gun. These improvements greatly increase the play value of an air/vortex ring gun.

The gun uses an improved aiming system obtained by making the center of the bore transparent along the entire length of the gun. Together with the transparent nature of the gun's projectile, this allows a coaxial sight down the center of the gun's bore. The gun also uses a precise air displacement system and design features to maintain cylindrical symmetry in the airflow. These features dramatically improve targeting accuracy, especially for guns with large barrels and air displacements that produce the most intense vortices.

The gun described in detail here is designed to produce strong vortex rings rather than air puffs since these have more desirable properties in target-type activities, but the same basic principles and designs outlined here apply to both kinds of guns. The gun described here has an output aperture design to maximize vortex ring strength and velocity for a given air displacement in the bore, making it suitable for target-type activities with targets placed from small to large distances (at least 15 feet) away from the gun. At large distances, the air forces at the target are due almost entirely to a localized vortex ring (the blast of air that accompanies the vortex out of the gun's aperture is dissipated), maximizing the pleasing projectile-like behavior at the target.

The gun incorporates an improved safety screen to prevent objects inserted into the gun barrel from being projected outward, and an improved safety guard at its output that provides pressure relief in case the output opening is blocked while maximizing vortex ring strength.

The gun may have multiple "loaded" positions that produce different air displacements, allowing the vortex ring intensity and velocity to be varied. The vortex ring velocity can be made much slower than that of projectiles shot by conventional toy guns, allowing dramatic time delays (up to a few seconds) between firing and hits by the invisible vortex (reminiscent of "photon torpedos".) Vortex velocity can also be changed by using interchangeable output apertures of different sizes. These improvements realize a vortex ring gun that is safe and entertaining to use and highly effective in target type activities.

The same design features described here can be used to improve guns designed to shoot smoke rings. A different kind of vortex ring gun, based on smoke ring guns, shoots vortex rings containing odor molecules produced by injecting a mist or spray containing the molecules into the gun barrel before firing. This gun allows a localized odor to be delivered to a target.

Several kinds of target well suited for use with accurate vortex ring guns are described: targets that are knocked or bent over, simulating a cartoon character's response to being shot; targets that spin or rotate about a horizontal or vertical axis normal to vortex direction; and targets that spin about an axis parallel to the vortex direction. With appropriate decoration, these targets provide a range of entertaining play possibilities that highlight the unusual features of these guns.

BRIEF DESCRIPTION OF THE DRAWING

FIG. 8A shows a side view of a target in an upright position. FIG. 8B shows a front view of the target in an upright position. FIG. 8C shows a side view of the target in a knocked over position.

FIG. 9A shows a side view of the target shown in FIG. 8A modified to resemble a person. FIG. 9B shows a front view of the target.

DETAILED DESCRIPTION OF THE INVENTION

Figure 1:
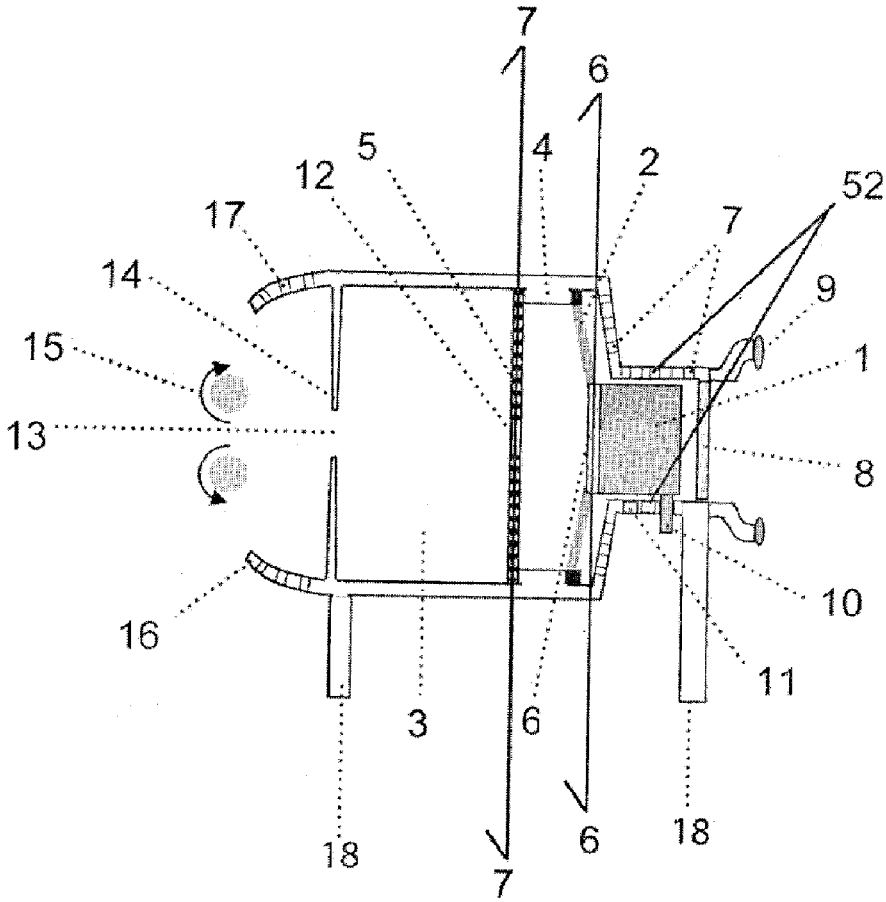
FIG. 1 shows a left side cross-section of the toy gun of a first embodiment.
Figure 6:
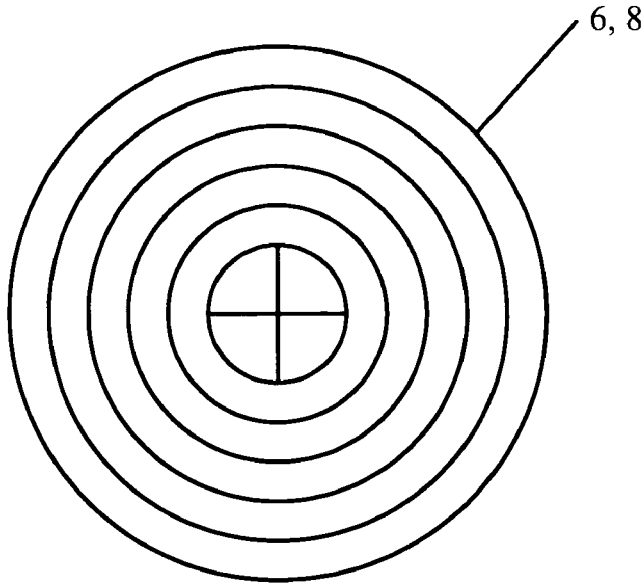
FIG. 6 shows a front view of the piston face in the toy gun.

FIG. 1 shows a left side cross-section view of a vortex ring gun of a first embodiment. A hollow cylindrical piston 1 moves in a cylindrical barrel under the action of an elastic membrane 2. The membrane is attached to the outer edge of the piston and to the inner diameter of the cylindrical air displacement chamber 3, on one end of a spacer 4 separating the piston from the safety screen 5. The piston face 6 is made of a transparent material, such as transparent plastic, and can be marked as shown in FIG. 6, although this is unnecessary if the safety screen is also used. The word "transparent" in this case means capable of transmitting light so that objects and images beyond can be clearly seen, including looking through windows or a clear barrel. The total mass of the piston is minimized (for example, by filling its cylindrical sides with holes) to reduce the gun's recoil when fired.

The barrel in which the piston slides has vent holes 7 to allow air to escape and enter the barrel as the piston moves. The rear end of the barrel is sealed by a transparent window 8 made of, for example, a transparent plastic, that can be marked as shown in FIG. 6. Rests 9 for the user's head when aiming the gun may have shock absorbing padding, and act to reduce glare on the transparent window. Alternatively, the vent holes 7 can be eliminated and the window 8 may contain holes for airflow, but this directs air towards the user's eye. The piston is "cocked" by pulling it back using handle 10 to one of three locked positions 11; these positions determine the air displacement of the piston when it moves forward when the handle is moved out of its locked position. Any standard multiple position trigger mechanism can be used in place of the one shown.

The piston is guided in its path by the cylindrical barrel 52 in which it resides, which ensures that the motion of the piston face is purely axial. Additional guides (e.g., of a tongue and groove type) running parallel to the barrel's axis on the piston and barrel can be used to eliminate any rotation about the axis of the piston. Alternatively, the piston can be eliminated and an air-displacing member can be guided to move in a purely axial direction by a "tongue and groove" mechanism around its periphery, or by guiding rods that project along the barrel axis forward or rearward from the air-displacing member at any radius from its center, and that slide through guides or channels within the barrel.

Figure 7:
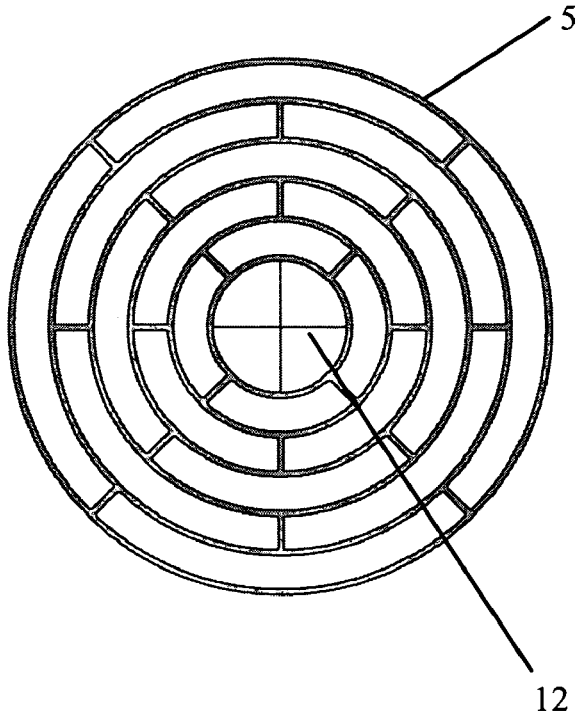
FIG. 7 shows a front view of the safety screen in the toy gun.

The safety screen 5 has a cylindrically symmetric array of openings and a large open area fraction, as shown in FIG. 7. This screen prevents solid objects placed in the air displacement chamber 3 from contacting the piston face 6 and elastic membrane 2. The screen 5 has a circular opening 12 with narrow crosshairs, as shown in FIG. 7. When the piston moves forward, air is pushed through the screen 5 and out circular opening 13 formed by the aperture containing member 14. U.S. Pat. No. 4,157,703 to Brown et al. (1979) describes a safety screen but with a rectangular pattern of holes that disrupted the cylindrical symmetry of the airflow. Brown et al.'s screen also lacks the cross hairs, so that it cannot perform the additional function of assisting in aiming the gun.

The aperture containing member 14 defining opening 13 is transparent (for example, made of a transparent plastic) to allow easy location of the target, and has a very small thickness at the aperture edge, thereby providing maximum conversion of the forward motion of the air into a vortex ring 15 according to well established principles of fluid mechanics. For sturdiness the aperture-containing member 14 may be thicker at its outer edges. This member can be removable, allowing apertures with different diameter openings to be used, providing vortex rings of different size, strength and speed.

The safety guard 16 is a curved continuation of the gun barrel past the aperture containing member 14. The inside diameter at its outlet is larger than the vortex ring diameter so that it does not interfere with the ring, but may be smaller than the diameter of a child's head. Cylindrically symmetric vents 17 running circumferentially in this guard 16 relieve pressure if the guard opening is blocked. The gun is supported by two hands using hand holders 18. U.S. Pat. No. 4,157,703 to Brown et al. (1979) describes a vented safety guard that curves in the opposite direction to 16 and that has a diameter smaller than the vortex diameter. Consequently, this safety guard largely destroys the vortex ring component of the exiting air, and so functions as a traditional air gun (as claimed in the patent) rather than a vortex ring gun.

To aim the gun, the user looks through the transparent windows 8 and 6, the transparent safety screen 5 and the circular aperture 13 of the transparent aperture—defining member 14 at the target, aligning the crosshairs in windows 8 and 6, the crosshairs 12 in the safety screen and the circular aperture 13 on the target. Thus, targeting is performed by viewing directly along the axis of the gun barrel, and is assisted by the cross hairs on the rear window and the safety screen.

The cylindrically symmetric design and the purely axial and reproducible motion of the piston 1 ensures that the vortex ring is accurately and reproducibly projected along the same axis. Consequently, the air displacement chamber diameter can have any size (from a few inches to a few feet or more) and still allow accurate targeting at arbitrary distances from the target. To maximize the viewable angle, the piston diameter should be large and its length and the overall length of the gun kept reasonably short. As with telescopes, optical elements can be inserted to increase the viewing angle, and a 90-degree reflector inserted to the right of or in place of the window 8 to allow aiming by viewing downward into the reflector.

Figure 2:
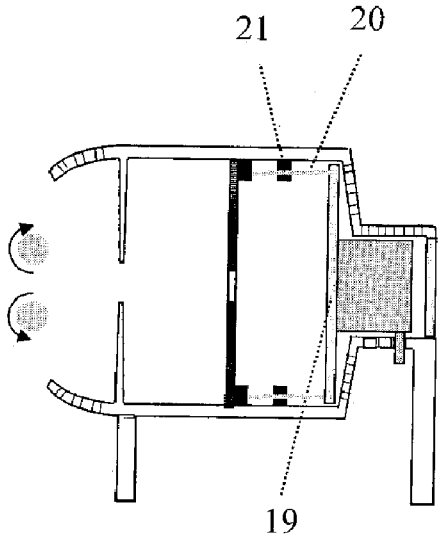
FIG. 2 shows a left side cross-section of the toy gun of a second embodiment.

FIG. 2 shows another embodiment in which the flat piston face 19 has a diameter comparable to that of the air displacement chamber. In place of the elastic membrane, springs or pre-tensioned elastic cords 20 attached symmetrically to the outer edge of the piston face pull the piston forward. The forward travel is limited by the cushioned stop 21. This design may produce more recoil than in the first embodiment shown in FIG. 1.

Figure 3:
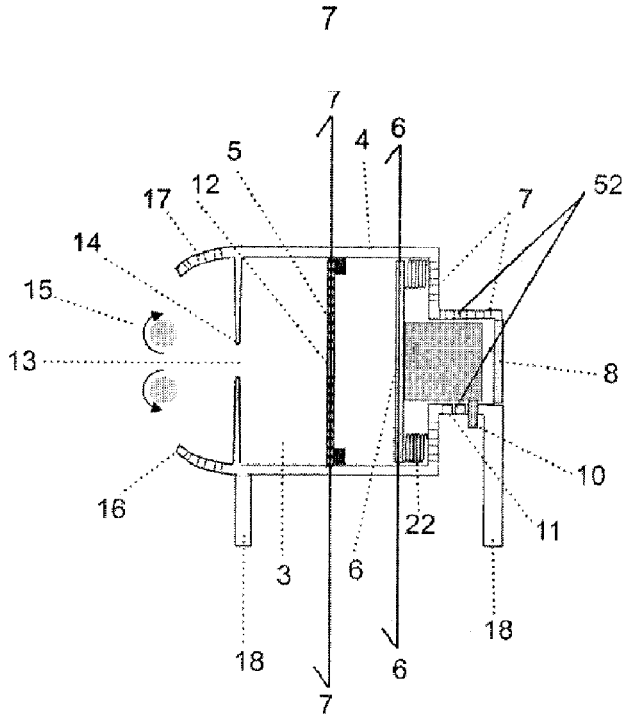
FIG. 3 shows a left side cross-section of the toy gun of a third embodiment.
Figure 4:
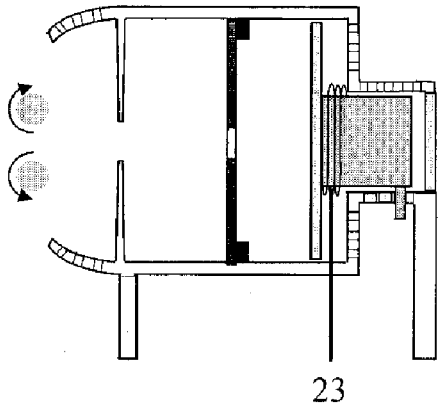
FIG. 4 shows a left side cross-section of the toy gun of a fourth embodiment.

In the alternative embodiments shown in FIGS. 3 and 4, the piston face is driven forward by springs 22 or a single spring 23, respectively. Again, a cushioned stop may limit forward travel. Alternatively, the guard may be moved forward and the spring length adjusted so that maximum spring compression produces a maximum forward motion of the piston face that stops short of the guard. Like the elastic membrane in FIG. 1, the resulting damped oscillation of the piston face after firing may help reduce gun recoil.

Other mechanisms can also be used to create air displacements. For example, the elastic members can be replaced by an electromagnetic coil and magnets to produce an axial electromagnetic drive, as in a loudspeaker.

Figure 5:
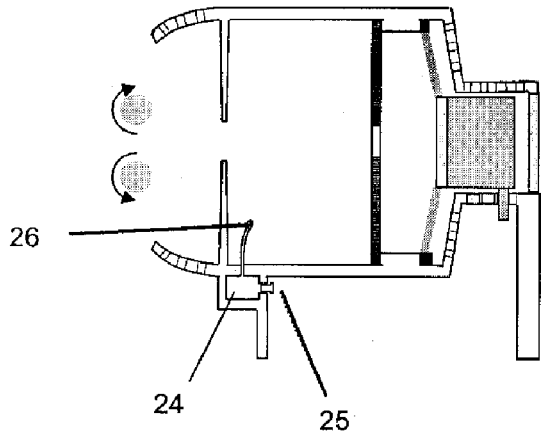
FIG. 5 shows a left side cross-section of the toy gun of a fifth embodiment.

FIG. 5 shows a left side cross-section view of a fifth embodiment, which shoots scented air vortex rings. A mechanism for injecting a spray containing odor molecules into the air displacement barrel is added. One method, based on standard squirt or water guns, uses a reservoir 24 that is filled through a capped fill hole (not shown). By pressing pump button 25 (sealed by an o-ring like seal to the reservoir), odor-molecule-containing liquid is forced out of the reservoir through the tube and out through the nozzle 26, which converts it to a fine spray. This spray can be directed at the safety screen 5, maximizing the transfer of odor molecules to the vortex formed when the gun is fired. Odor containing molecules could also be injected using an aerosol can (with a gun button pushing the can and opening its valve) or using a venturi-type atomizer arrangement in which the air flowing past the nozzle sucks and disperses odor containing fluid into the stream.

FIG. 6 shows a possible design for patterns on the transparent windows 6 and 8 to assist in aiming the gun at a target. FIG. 7 shows a design for the safety screen 5 that preserves the cylindrical symmetry of the airflow and assists in aiming the gun.

FIG. 8A–C shows a side view of a target, a front view of the target standing, and a side view of the target knocked over by the forces exerted by a moving vortex ring, respectively. The target is comprised of a lightweight vertical portion 27 and a heavier base 28, and may be made of one piece or two separate pieces. The vertical portion presents an area normal to the vortex that is comparable to the size of the vortex ring (e.g., within a factor of 3 or so). The target's mass distribution and coefficient of friction with the supporting surface are such that when struck by a puff of air due to a vortex ring, the target rotates about the point 29 and flops over without sliding along the surface. The bottom surface of the base 28 may be coated, textured or corrugated to increase friction. Targets with low center of mass are preferred over those with high center of mass because the latter are less stable and harder to set up. This target is similar to that described in U.S. Pat. No. 1,473,178 to Dray (1923) which had the vertical member centered in the base rather than at its back edge. This difference is important because the present design allows a clean rotation about the pivot point 29 without sliding, to simulate the "keeling over" of e.g., Looney Toons cartoon characters.

FIGS. 9A–B shows a side view and a front view of the target in FIGS. 8A–C modified to resemble a person.

Figure 10:
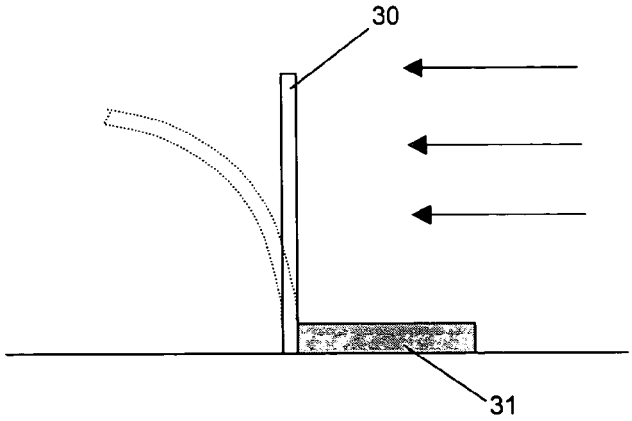
FIG. 10 shows a side view of a target where the vertical member of the target bends when struck by a vortex ring.
Figure 11:
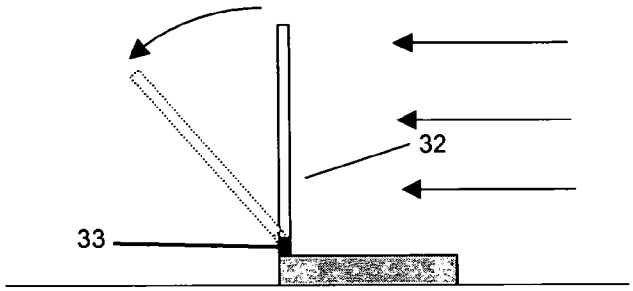
FIG. 11 shows a side view of a target where the elastic piece of the target bends when the target is struck by a vortex ring.
Figure 12:
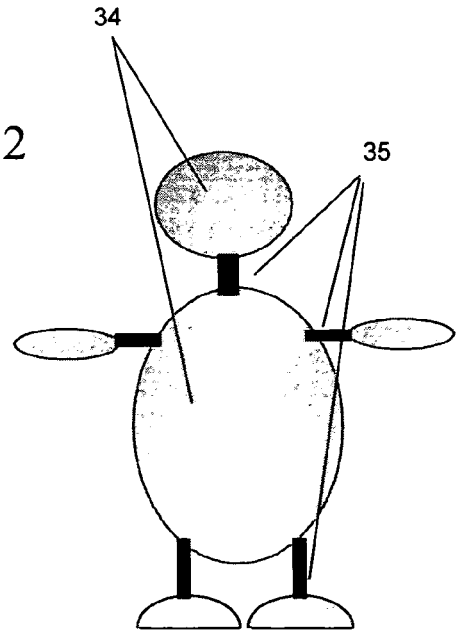
FIG. 12 shows a front view of a composite target, where the body pieces are targets that bend on impact from a vortex ring.
Figure 13:
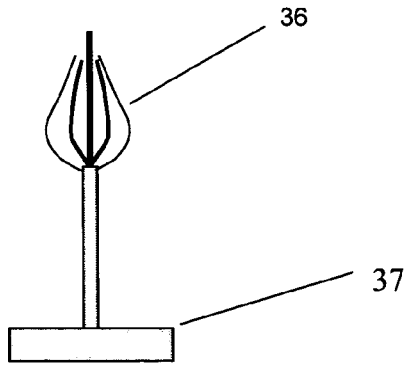
FIG. 13 shows a front view of a target that consists of a plurality of flexible rods that bend on impact from a vortex ring.

FIGS. 10–13 show four examples of targets of another embodiment that bend when struck by a vortex ring. In FIG. 10, the lightweight vertical member 30 is made elastic with a soft spring constant so that it bends when hit by a vortex ring while the base 31 remains stationary. To keep it stationary, the base may be heavy, or may stick via suction or e.g., a hook and loop fastener to a surface. In FIG. 11, a rigid vertical member 32 is connected to a heavy base by an elastic piece 33, so that the bending occurs primarily in the elastic piece 33. FIG. 12 shows a front view of a composite target consisting of lightweight, large area "body" pieces 34 connected by elastic elements 35. Only those parts of the body that are struck by a vortex will bend initially. FIG. 13 shows a target that consists of a plurality of very flexible rods or strips 36 (e.g., like the thin plastic frills at the end of party horns) oriented vertically and attached to a base 37. When struck by a vortex ring they bend and flutter, simulating the behavior of a candle in the wind.

Figure 14A:
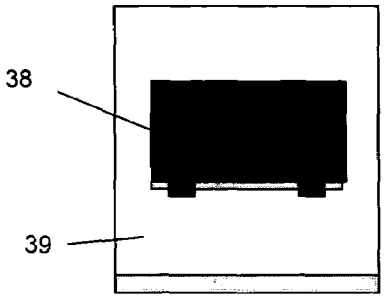
FIG. 14A shows a front view of an alternative target that flops open when struck by a vortex ring.
Figure 14B:
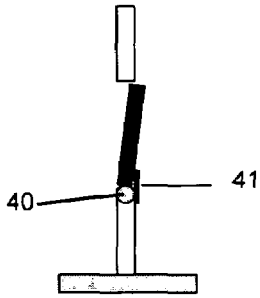
FIG. 14*b* shows a side view of the alternative target.
Figure 14C:
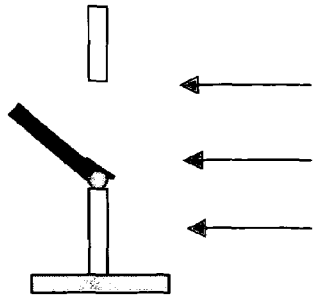
FIG. 14C shows a side view of the alternative target after struck by a vortex ring.

FIGS. 14A–C show front and side views of another alternative target that flops open when struck by a vortex ring. In its resting position, the door 38 tilts forward slightly relative to the supporting frame and base 39 on its hinge 40, with its forward position limited by the tab 41. When hit by a vortex ring the door rotates backward, as shown in FIG. 14C.

Figure 15:
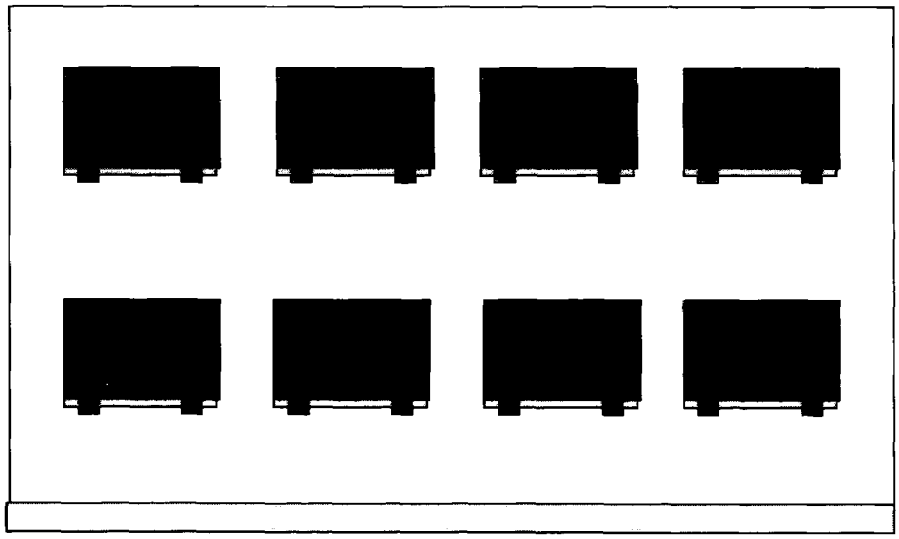
FIG. 15 shows a front view of a composite target comprising a plurality of targets shown in FIGS. 14A–C.

FIG. 15 shows a composite target consisting of several targets of the type shown in FIGS. 14A–C. This provides a target "gallery". A separate sheet held behind the doors may contain images of different people or objects that are revealed when a door is hit.

Figure 16A:
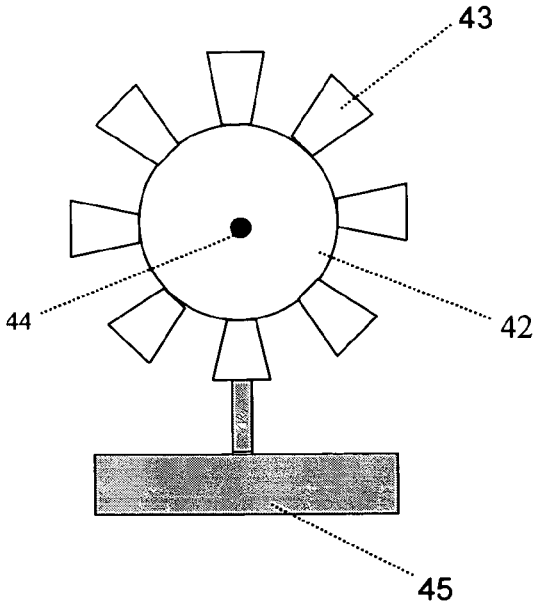
FIG. 16A shows a front view of another alternative target that rotates about an axis parallel to the vortex ring direction when struck.
Figure 16B:
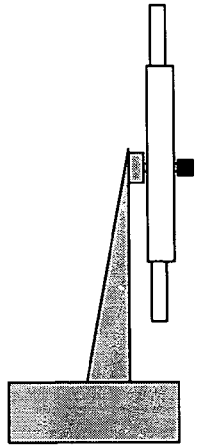
FIG. 16B shows a side view of the target.
Figure 16C:
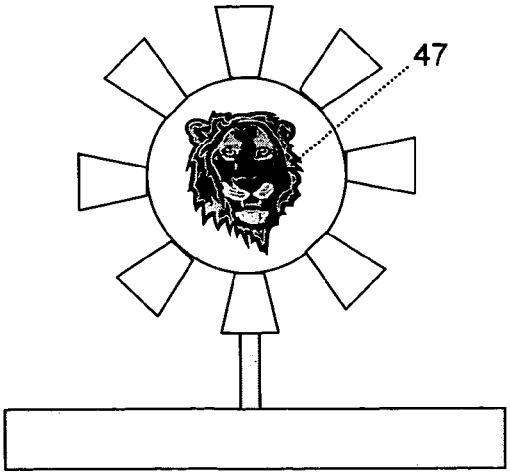
FIG. 16C shows a front view of the target with an animal on its face.

The targets in FIGS. 8–15 may all be used with standard solid or liquid projectile shooting guns. The targets in FIGS. 16A–C and 17 take advantage of the unique character of the vortex ring projectile to cause targets to rotate. The targets of FIGS. 16A–C and FIG. 17 rotate about an axis parallel to vortex ring's direction of motion when struck by a vortex ring, like a fan. FIGS. 16A and 16B show front and side views of one fan-like target. As shown in FIG. 16A, the target consists of a face disk 42 whose diameter is preferably smaller than that of the vortex ring core, and blades 43 that are angled so that the moving air creates a torque about the rotation axis 44. The fan is attached to a base 45, with one possible attachment scheme shown in FIG. 16B. The rotating fans may be decorated with geometric patterns, objects like animals (46 in FIG. 16C) or people, etc., to make them more appealing targets. This kind of target action cannot easily be implemented in guns that use solid projectiles. The moment of inertia of the rotating member about the rotation axis should be as small as possible to allow rapid angular acceleration. In practice, this requires that the rotating pieces be made very thin and light.

Figure 17:
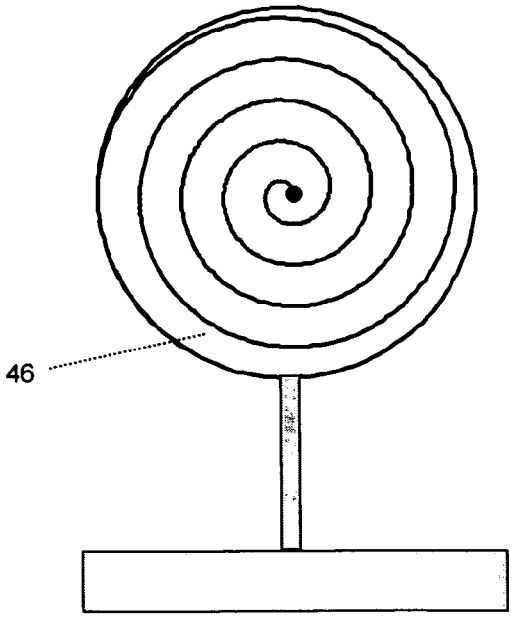
FIG. 17 shows a spiral or screw-type fan target.
Figure 18A:
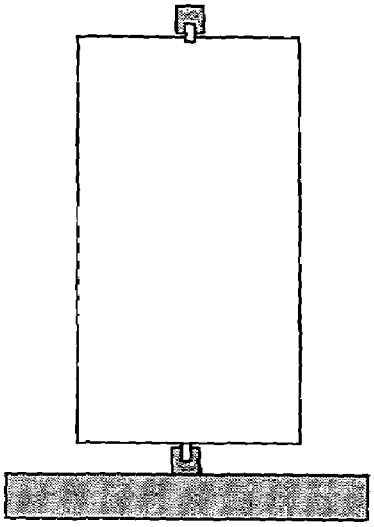
FIG. 18A shows a front view of an alternative target that rotates about a vertical axis when struck by a vortex ring.
Figure 18B:
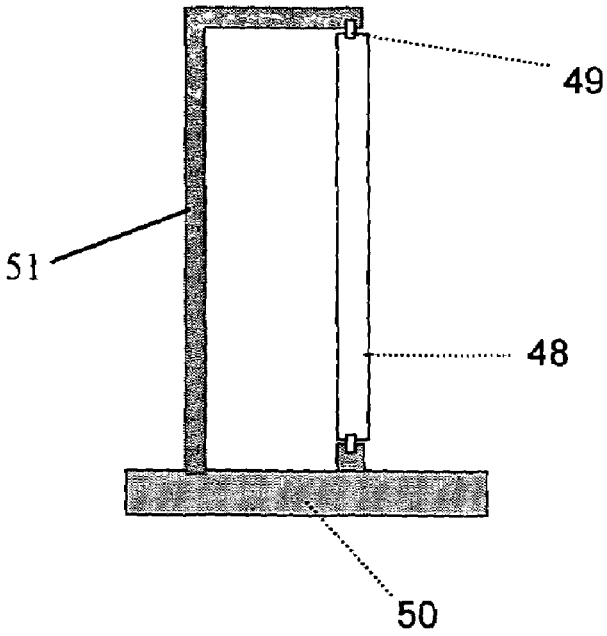
FIG. 18B shows a side view of the alternative target.
Figure 19:
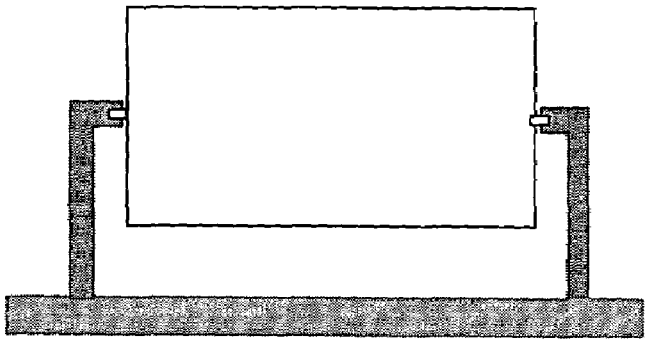
FIG. 19 shows a front view of a target that rotates about a horizontal axis.

Other standard fan configurations may be used, such as the spiral or screw-type fan 47 in FIG. 17 (which spirals out of the plane of the paper), or the simple pinwheel fans formed by folding four corners of a square to their center. FIGS. 18A–B show front and side views of a target that rotates about a vertical axis when struck by a vortex ring. The lightweight, large area target 48 is supported by pivots 49 connected to a base 50 and vertical support 51. Because of the cylindrical symmetry of the vortex ring it must strike the target off-center in order to cause rotation. The target may consist of a single blade as shown or of multiple blades as in a barrel-type fan. FIG. 19 shows a front view of a target that rotates about a horizontal axis.

The present invention comprises a new approach to vortex ring guns. Its particular advantage is that aiming is performed by directly viewing along the axis along which the vortex travels, and that the air flow within the gun is highly reproducible and cylindrically symmetric, which makes the gun suitable for target-type activities requiring high accuracy. Accurately aimable guns of arbitrary size may be made by this approach. The gun also includes important safety features to prevent objects placed inside the barrel from being projected outward and to protect against, e.g., ear damage if the vortex exit opening is blocked. Both are designed to maximize the exiting vortex's strength and preserve the axial symmetry of the airflow. In addition, several examples of targets are provided that take advantage of this vortex gun's high aiming accuracy and that greatly increase its play value.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A toy air gun comprising:

a cylindrical hollow barrel having a central axis and comprising:

an open first end;

a second end having a transparent central portion;

a first section with a diameter adjacent to the open first end; and a second section with a diameter adjacent to the second end;

a moveable member with a diameter less than the diameter of the second section of the barrel, fitted coaxially within the second section so that the moveable member is constrained to move axially along the barrel, and having a transparent central portion; and an elastic element for biasing the moveable member towards the first end, coupled to the moveable member and the barrel such that when the moveable member is pulled back against the elastic element and released, the moveable member moves coaxially along the axis of the barrel to force air to travel forward and out the open end of the barrel, and the entire length of the gun being transparent along the central axis, such that the transparent central portion of the second end of the barrel and the transparent central portion of the movable member forms a coaxial sight down the axis, allowing a user to aim the gun by sighting directly along the central axis of the gun barrel through the transparent central portion of the moveable member and the transparent central portion of the second end of the barrel.

2. The toy air gun of claim 1, wherein the moveable member is a piston.

3. The toy air gun of claim 2, wherein the piston is hollow.

4. The toy air gun of claim 2, wherein the piston is solid.

5. The toy gun of claim 1, further comprising guides in the second section of the barrel for guiding the moveable member to restrict rotational motion of the moveable member.

6. The toy gun of claim 1, further comprising a safety screen within in the barrel between the first end and the moveable member to prevent objects placed in the barrel from being displaced by the moveable member.

7. The toy gun of claim 6, wherein the safety screen has cross hairs along a center axis of the barrel.

8. The toy air gun of claim 1, further comprising a safety guard on the open first end of the barrel for preventing a build-up of pressure within the barrel if the open end is blocked that at the same time maximizes any vortex ring component of the air exiting when the barrel and guard are not blocked.

9. The toy air gun of claim 1, further comprising vent holes in the transparent central portion of the second end of the barrel.

10. The toy air gun of claim 1, further comprising vent holes in the barrel rearward of the moveable member.

11. The toy air gun of claim 1, wherein the diameter of the first section is greater than the diameter of the second section.

12. The toy air gun of claim 1, wherein the elastic means is an annular diaphragm having an inner opening surrounding the moveable member and an outer periphery sealed to an inner surface of the barrel.

13. The toy gun of claim 1,wherein the elastic means is a spring.

14. The toy gun of claim 1, wherein the elastic means is a magnet.

15. The toy gun of claim 1, wherien the elastic means is an electromagnetic coil.

16. The toy air gun of claim 1, wherein the transparent central portion at the second end of the barrel has cross hairs along a center axis of the barrel.

17. The toy air gun of claim 1, wherein the transparent central portion of the moveable member has cross hairs along a center axis of the barrel.

18. The toy gun of claim 1, wherein the moveable member has a flat face.

19. The toy air gun of claim 18, wherein the flat face of the moveable member extends across a diameter of the barrel.

20. The toy gun of claim 1, further comprising an aperture containing member located adjacent to the open first end of the barrel, having an opening along the central axis of the barrel, for maximizing a vortex ring component of air exiting the barrel.

21. The toy gun of claim 1, further comprising a scent dispenser for dispensing a scent between the open first end and the second end of the barrel.

22. The toy gun of claim 1, further comprising eye rests coupled to the second end of the barrel.

23. The toy air gun of claim 1, further comprising a target having a vertical member and a base for receiving the vertical member, such that when the vertical member is struck by an air vortex ring from the toy air gun, the vertical member moves.

24. The target of claim 23, wherein the vertical member bends when struck by the air vortex ring.

25. The target of claim 23, wherein the vertical member rotates when struck by the air vortex ring.

26. The target of claim 25, wherein the vertical member rotates about a horizontal axis normal to the axis along which the air vortex ring moves.

27. The target of claim 25, wherein the rotation of the vertical member is about a central axis.

28. The target of claim 25, wherein the rotation of the vertical member is about a vertical axis.

29. The target of claim 23, wherein the vertical member is of a shape representing a profile of a human or animal.

30. The target of claim 23, wherein the vertical member is propeller shaped, fan blade shaped, pinwheel shaped, or "egg beater wind turbine" shaped.

* * * * *

UNITED STATES PATENT AND TRADEMARK OFFICE

CERTIFICATE OF CORRECTION

PATENT NO. : 7,191,774 B2
APPLICATION NO. : 10/871826
DATED : March 20, 2007
INVENTOR(S) : Robert E. Thorne It is certified that error appears in the above-identified patent and that said Letters Patent is hereby corrected as shown below:

Title Page, Item (54) Title and Col. 1, Line 1

Replace "ACCURATE TOY AIR GUN TARGETS" with --ACCURATE TOY AIR GUN AND TARGETS--

Column 9:

Line 22: replace "within in" with --within--

Signed and Sealed this

First Day of May, 2007

JON W. DUDAS
*Director of the United States Patent and Trademark Office*